US005371987A

United States Patent [19]

Hirsch et al.

[11] Patent Number: 5,371,987

[45] Date of Patent: Dec. 13, 1994

[54] ACOUSTICAL DOOR

[75] Inventors: James A. Hirsch, Santa Monica; Scott C. Stewart, Downey, both of Calif.

[73] Assignee: Security Metal Products Corp., Hawthorne, Calif.

[21] Appl. No.: 978,865

[22] Filed: Nov. 19, 1992

[51] Int. Cl.[5] ..... E06B 5/20

[52] U.S. Cl. ..... 52/207; 49/239; 49/368; 49/470; 49/475.1; 49/489.1

[58] Field of Search ..... 49/239, 468, 470, 475.1, 49/489.1, 495.1, 366, 367, 368; 52/207

[56] References Cited

U.S. PATENT DOCUMENTS

| | | | |
|---|---|---|---|
| 2,555,244 | 3/1951 | Pietrushak | 49/470 X |
| 3,221,376 | 12/1965 | Smeltzer . | |
| 3,273,297 | 9/1966 | Wehe, Jr. . | |
| 3,295,273 | 1/1967 | Wehe, Jr. . | |
| 3,319,738 | 5/1967 | Wehe, Jr. . | |
| 3,362,108 | 1/1968 | Jones | 49/366 |
| 3,678,627 | 7/1972 | Dixon | 49/368 X |
| 3,690,037 | 9/1972 | Kempel | 49/468 X |
| 3,919,808 | 11/1975 | Simmons | 49/367 |
| 4,020,595 | 3/1977 | Duncan | 49/470 X |
| 4,167,088 | 9/1979 | Governale | 49/381 X |
| 4,429,493 | 2/1984 | Aubin | 49/367 |
| 4,731,952 | 3/1988 | Mascotte | 49/468 X |
| 5,045,636 | 9/1991 | Johnasen et al. | 49/239 X |
| 5,056,263 | 10/1991 | Bies | 49/470 X |

FOREIGN PATENT DOCUMENTS

| | | | |
|---|---|---|---|
| 893470 | 7/1944 | France | 49/367 |
| 2819617 | 11/1979 | Germany | 49/468 |

OTHER PUBLICATIONS

Xerox copies of pages from Krieger Steel Products Co. "Kriegersonic Acoustical Doors" BuyLine 5236.

Xerox copies of pages from Overly Manufacturing Co. "Sound-Retardant Doors and Windows".

*Primary Examiner*—Carl D. Friedman

*Assistant Examiner*—Kevin D. Wilkens

*Attorney, Agent, or Firm*—Knobbe, Martens, Olson & Bear

[57] ABSTRACT

An acoustic door system including an improved peripheral seal and a lower adjustable seal. An acoustic door swings on camming hinges which raise the door upon opening. A lower vertically adjustable U bracket has a lower neoprene sealing strip which contacts the threshold of the door frame. The peripheral seal has a portion compressed between the marginal edge of the door and frame and a portion compressed between the door panel and frame, providing acoustical sealing between the frame and two perpendicular surfaces of the door. In another form, an improved astragal gasket is compressed in the central gap between a pair of doors, the gasket also contacting an inner panel of both doors.

15 Claims, 7 Drawing Sheets

ACOUSTICAL DOOR

BACKGROUND OF THE INVENTTION

The present invention relates to acoustical doors, and more particularly, to an acoustical door system having improved perimeter seals.

Sound-retardant doors and windows are used extensively not only in performing arts centers, concert halls, broadcast studios, auditoriums and movie theaters, but also in critical industrial, aerospace and defense installations, as well as in other locations where noise control and/or voice privacy may be required. When sound energy within a room meets a barrier, part of its energy can be absorbed by the barrier and part reflected. The remaining vibrating energy puts the barrier into motion and it becomes a second transmitter, thereby radiating sound into adjacent areas. The construction materials and techniques used in enclosing the source noise will govern the amount of energy transferred from the source area to adjoining spaces.

Sound energy impinging on barriers can be absorbed with embedded porous materials in which the sound waves produce motion, thereby doing work and dissipating energy as heat. To reduce the amount of energy radiated by a barrier, a damping material may be applied to decrease the overall motion of the barrier. Typically, such materials are limp, and provide excellent vibration control and damping. The effectiveness of a barrier material thus is enhanced by an optimum combination of absorptive and damping materials. In this respect, although a limp-mass material offers good sound barrier properties, it is not practical for exterior applications. Most sound barrier exterior materials are hard, stiff, dense and very reflective. The composite of outer stiff and inner limp material functions as an effective sound barrier. Such composites are used in sound-retardant doors, also known as acoustical doors.

In the past, the common practice in sound-retardant door designs generally followed that for commercial freezer and refrigerator doors, using wood, metal, cork, mineral insulation, lead sheets and other materials in a thick sandwich configuration. In general, each material, according to its mass, retards penetration of a segment of the particular sound frequencies involved. However, doors were massive—4, 5 and 6 inches thick—and required special hardware derived from commercial refrigeration doors. The thick doors, although relatively good sound barriers were aesthetically unappealing and presented problems with fire safety, ease of entrance and exit, and compatibility with the building locking system.

More recently, the engineering of sound barriers has developed to the point where fairly effective acoustical doors of 1¾ inch thickness are available. Examples of the designs of prior art acoustical doors are found in U.S. Pat. Nos. 3,273,297, 3,295,273 and 3,319,738.

The performance of a sound barrier is currently given in terms of a "sound transmission class" (STC). STC is a single number rating derived from measured values of sound Transmission Loss (TL) in accordance with American Society for Testing and Materials (ASTM) standards. TL through a door is a measure of its effectiveness in preventing the sound power incident on one side from being transmitted through it and radiated on the other side, taking into account the area of the door and the absorption in the receiving room. The STC provides a single number estimate of a door or a window's performance for certain common sound reduction applications.

To provide a tangible measure of STC values, sound-attenuation classifications and acoustic isolation criteria (voice range only) for construction of various sound-sensitive rooms have been defined. The criteria are as follows:

| | |
|---|---|
| Sound Group I | $30 \leqq STC < 40$ |
| Sound Group II | $40 \leqq STC < 45$ |
| Sound Group III | $45 \leqq STC < 50$ |
| Sound Group IV | $50 \leqq STC$ |

Sound levels in secure facilities which serve as private offices or laboratories comprise Sound Group II. Sound Group III rooms are described as standard executive suites, open work spaces, briefing or conference rooms, planning and training rooms, projector rooms, and auditoriums that do not require sound amplification. Auditoriums with sound reinforcements, combat centers, war rooms and battle management areas all fall within Sound Group IV.

In the laboratory, TL measurements are conducted in two adjacent highly reverberant rooms, presenting a diffused sound field, requiring walls with acoustical properties far superior to the test specimen. The specimen to be tested is sealed in an opening between the two rooms and a calibrated noise source and frequency spectrum is activated. The same rotating microphone is used in each room to transmit measured sound levels to analyzers that determine the TL in decibels (dB) at each of 18 one-third octave bands between 100 and 5,000 Hz. The middle 16 TL readings between the 125 and 4,000 Hz one-third octave bands are plotted against a standard contour curve as established by ASTM standards. The result is a convenient single number rating (STC) that covers the primary speech frequencies and is an easy way for users to rank the relative effectiveness of sound barrier products.

Outside the controlled laboratory environment, however, factors affecting the acoustical performance of a specific door assembly also include the quality of perimeter seals, hardware, frame, and integration of the frame into the surrounding wall. A general rule of thumb is that if air, light or water can pass through gaps around a barrier, so can sound, and the effectiveness of well-designed acoustical doors can be destroyed by even relatively small peripheral openings. Thus, there is some discrepancy between an STC rating obtained in the laboratory and the actual effectiveness of the sound barrier when installed on site.

An operating test may be performed in the lab which measures the sound retardant effectiveness of the door and surrounding frame and seals. Such a test provides a reasonably accurate determination of the STC of the assembled acoustical door system.

A field test is a commonly used term referrinq to a test conducted at the job site, by a qualified acoustical consultant, to verify the operating test results for a particular barrier. The test provides a noise isolation class (NIC), a single number rating derived from measured values of noise reduction through the item tested, in accordance with ASTM standards. These figures are used to provide a Field Sound Transmission Class (FSTC). There is typically a difference between FSTC and operating STC ratings, but this difference should be minimal, no more than five points in most cases.

Currently, some acoustical doors make use of camming hinges, which lift the door when opened. Thus, the gap at the bottom of the door between the door and the door step is closed when the door is shut. Disadvantageously, current mortised seals disposed at the bottom of the door are attached to only one side, and interfere with a peripheral seal at that lower location. Various other designs for seals or gaskets on the periphery of the doors have been developed, in particular, as shown in U.S. Pat. No. 3,221,376. However, prior designs contact one panel of the door and require a large amount of compressive force to ensure a tight acoustic seal. Such large compression results in the door "bouncing back" upon unlatching.

As opposed to single doors, pairs of doors present a greater perimeter footage to be sealed around the periphery, as well as the central gap between the two doors. Presently, there is no specific standards for testing sound reduction through double doors. Based on empirical testing, it is not unusual to experience drops in laboratory STC values of up to 15 classes for the same doors installed on site as a pair. Typically, a sealing strip known as an astragal covers the central gap between the two doors.

The present invention is directed to the need for an effective acoustical door for single and double doors which is relatively simple and inexpensive, yet performs better than acoustical doors of the prior art.

SUMMARY OF THE INVENTION

The present invention provides an improved acoustical door with enhanced sound reduction characteristics between the door and the door frame. The acoustical door preferably swings on a plurality of divided hinges which lift the door when opened and lower the door when shut. When the door is shut, an adjustable sealing member at the bottom of the door rests firmly against the doorstep to shut out any sound transmission. An improved seal is provided around the two sides and top edges of the door frame which contacts two perpendicular surfaces of the door. The seals around the door frame are held in adjustable retainers for positioning the seals in order to create an optimum interference with the door. The elastomeric seals compress an optimum amount due to the interference with the door.

The preferred embodiment of the acoustical door includes a lower U bracket which fits onto the bottom edge of the door. Vertical slots in the bracket allow the bracket to be adjusted vertically on the bottom of the door with screws. A lower strip of elastomeric material is bonded to the bottom of the bracket to come in contact with the doorstep. The bracket and sealing material extend the full width of the door and terminate flush with the edges.

The present invention provides an improved elastomeric seal or gasket disposed on the sides and top of the door frame which come in contact with two perpendicular surfaces of the door. In this respect, the peripheral gaskets comprise a rectangular main body having a dog-leg portion extending between the door marginal edge and frame. Thus, the back panel of the door contacts a face of the main body while the marginal edge of the door contacts the dog-leg. A slit in the abutting face of the main body separates the contact regions so that the abutting face of the main body squarely contacts the rear face of the door. In this respect, the slit prevents the main body from being pulled transversely toward the dog-leg, which is compressed between the door marginal edge and frame.

Advantageously, the elastomeric gasket is held in a metallic retainer around the periphery of the door frame which may be adjusted horizontally to accommodate different thicknesses and assemblies of the door, and to provide an interference or compression adjustment. Furthermore, a cosmetic cover fits over the retainer to provide a pleasing appearance on the interior of the door.

In accordance with another preferred embodiment of the present invention, an improved astragal seal between the middle edges of a pair of doors is provided. The astragal seal is held in a retainer on the inner surface of one door so that a projection of the seal extends into the gap between the doors to be compressed therein. In this respect, the astragal seal generally comprises a rectangular body in cross section having a V-shaped projection on the edge facing out or between the gaps between the doors.

DESCRIPTION OF THE PREFERRED EMBODIMENT

Figure 1:
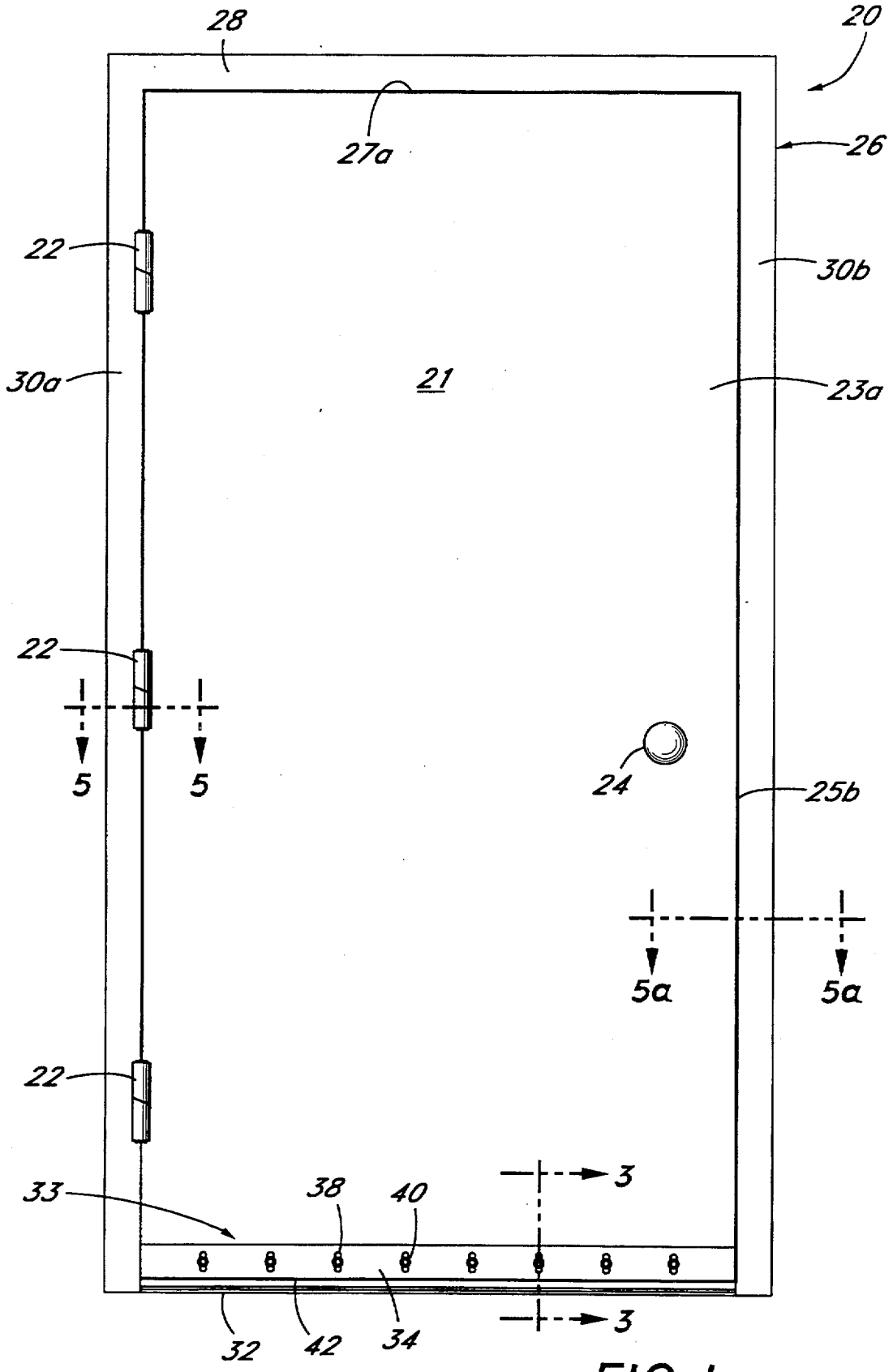
FIG. 1 is a front elevational view of an acoustical door system of the present invention with the door closed.

Referring to FIG. 1, the present invention provides an acoustical door system 20 having an improved sealing arrangement around the periphery of a single door 21. The door construction, per se, does not form a part of the present invention. An acoustical door, such as one of models 43M, 43P, 49M, 49P, 49U and 52U, manufactured by Security Metal Products Corp., is suitable. The door 21 may be of any thickness, but preferably $1\frac{3}{4}$ inch, and have maximum sound transmission loss.

Figure 2:
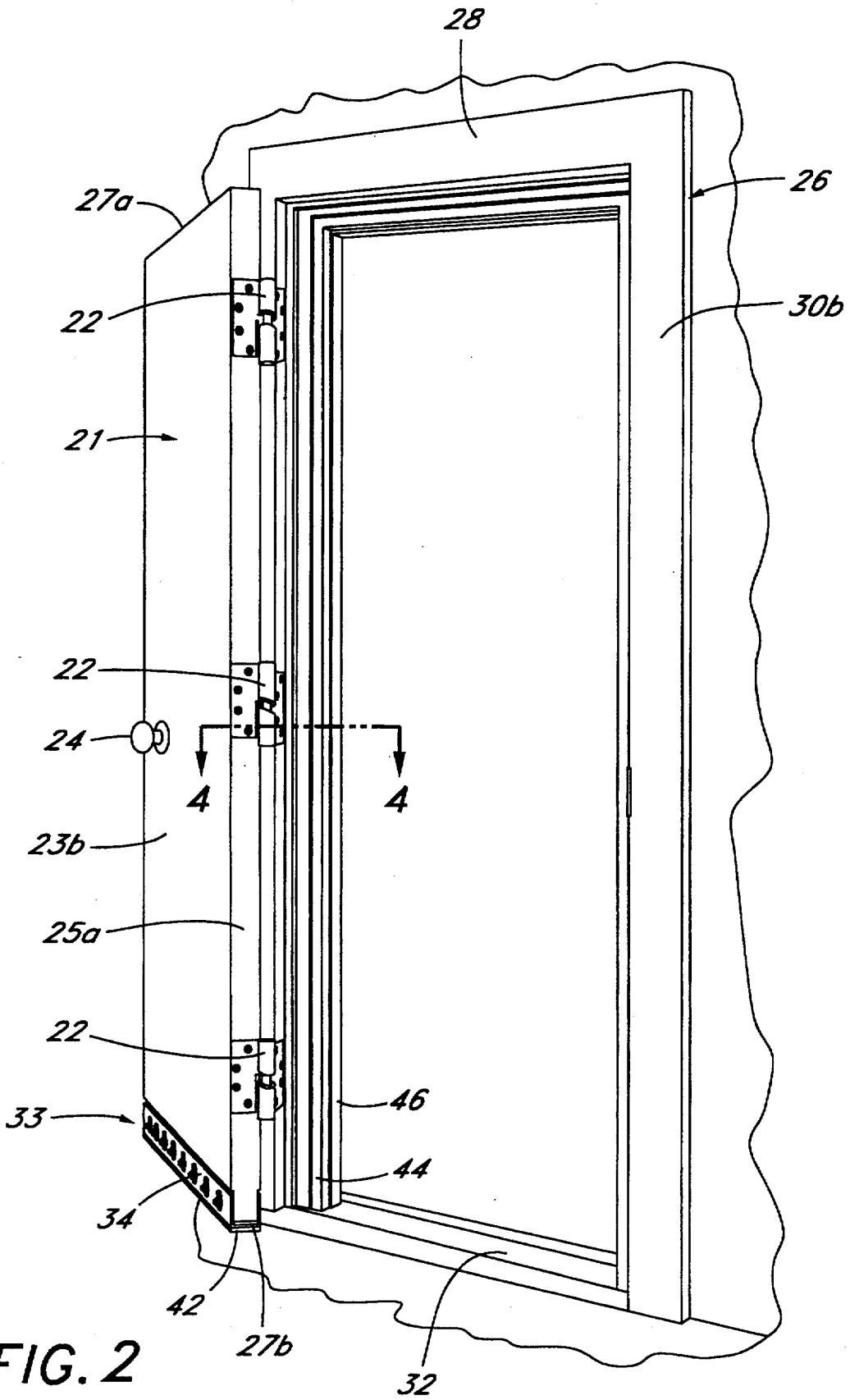
FIG. 2 is a perspective view of the acoustical door system with the door opened.

As shown in FIGS. 1 and 2, the door 21 pivots on three camming hinges 22 attached to the side of a door frame 26. The camming hinges 22 are split in a spiral fashion so that the door 21, when opened, will rise up approximately 1 inch from the doorstep. By way of definition, the door 21 opens inward and comprises an inner panel 23*a*, an outer panel 23*b*, left and right marginal edges 25*a* and 25*b*, respectively, and top and bottom marginal edges 27*a* and 27*b*. The door frame 26, of conventional construction, surrounds the door 21 defining the aperture the door must acoustically seal. The frame 26 comprises an upper piece 28, left and right door jambs 30*a* and 30*b*, respectively, and a threshold or doorstep 32. A conventional door knob 24, or other well known handle, and accompanying latching and locking system (not shown) are incorporated into the door 21.

In FIG. 2, the acoustical door 21 is shown opened and raised slightly above the frame doorstep or threshold 32. A lower seal 33 is attached to the bottom marginal edge 27*b* of the door 21 and comprises a lower U-bracket 34 and a flat strip of elastomeric sealing material 42 adhered thereto, forming an acoustical seal with the doorstep 32 when the door 21 is closed and lowered.

Figure 3:
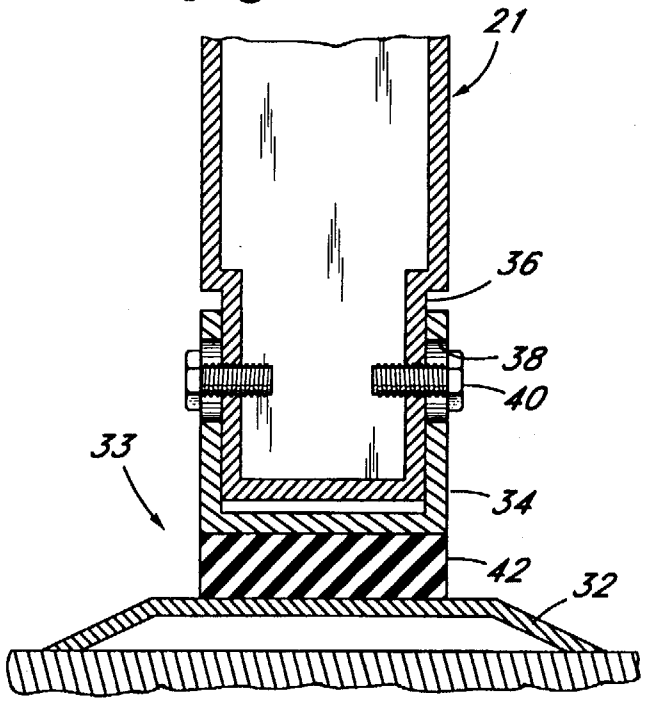
FIG. 3 is a cross-sectional view of the bottom U-bracket and elastomeric seal taken along line 3—3 of FIG. 1.

As best seen in FIG. 3, the U-bracket 34 fits over a narrow recessed region 36 to lie flush with the panels 23*a,b* of the door 21. The entire weight of the door 21 compresses the elastomeric sealing strip 42 against the doorstep 32, forming an effective acoustical barrier. Elongated slots 38 in the U-bracket 34 in combination with fasteners 40 provides a vertical adjustment for varying the compression of the elastomeric strip 42. When opening, the camming hinges 22 raise the door 21 quickly, reducing drag, even though acoustical doors of $1\frac{3}{4}$0 inch thickness weigh up to 300 lbs.

As illustrated in FIGS. 1 and 2, the lower U-bracket 34 extends the full width of the door 21 and terminates flush with the left and right marginal edges 25*a,b*. When closed, a continuous strip along each vertical left and right edge 25*a,b* of the door 21, and also a continuous vertical strip along each panel 23*a* and 23*b*, will contact a peripheral seal or gasket 44 disposed around the interior of the door frame 26, due to the flush end and recessed face assembly of the U-bracket 34 on the door.

Figure 4:
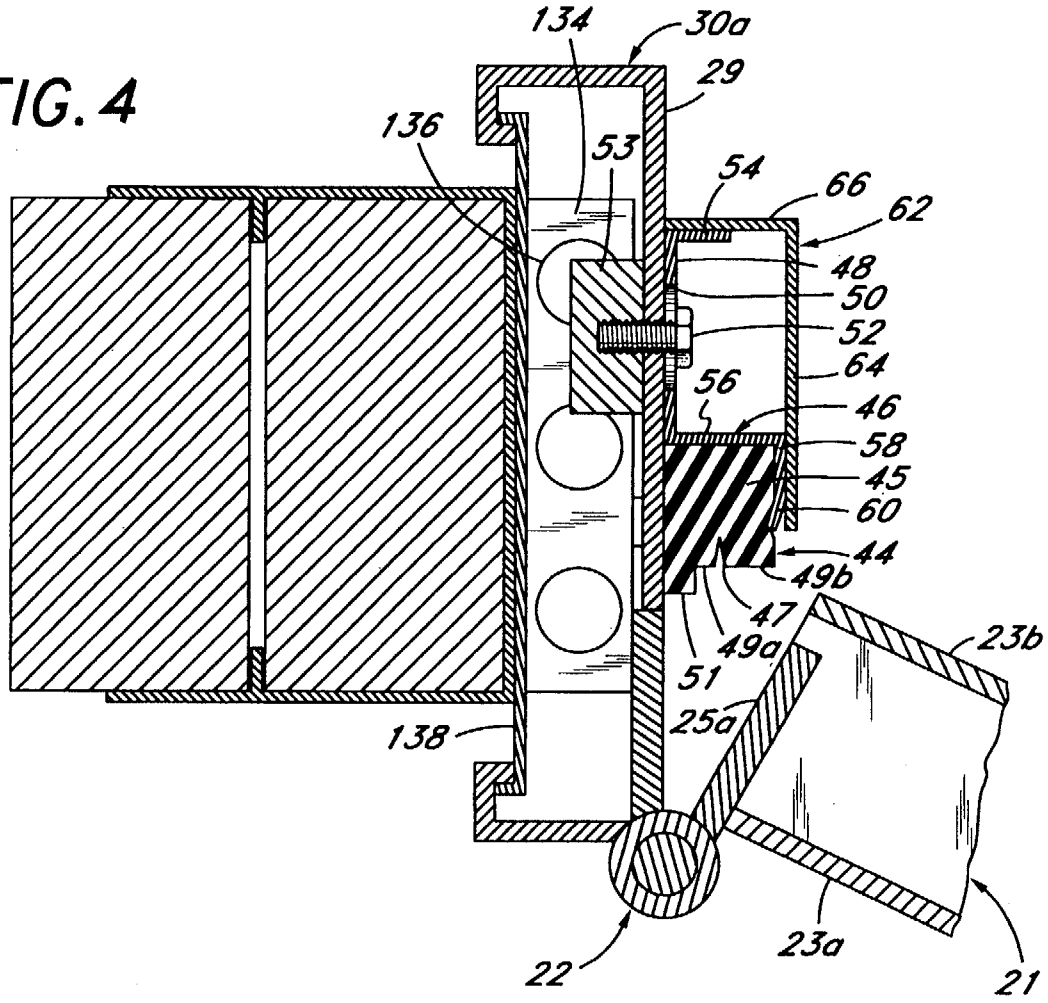
FIG. 4 is a cross-sectional view taken along line 4—4 of FIG. 2 through the hinge showing the door open and the peripheral gasket in an undeformed state.

As shown in cross-section of FIG. 4, the frame pieces 28, 30*a,b* generally comprise channel-shaped members having webs 29 parallel to the adjacent door edge. The peripheral gasket 44 is held proximate the web 29 of the door frame 26 by a gasket retainer 46. It will be understood that each retainer 46 and gasket 44 therein extends the full height and width of the door jambs 30*a,b* and top edge 28, respectively, and the corner portions are suitably connected to provide a continuous sealing member around the left, right and top of the door.

As shown in FIG. 4, the gasket 44 in its undeformed state, comprises a main body portion 45 of generally rectangular cross-section, a V-shaped slit 47 dividing an inner face into a first and second sealing regions 49*a* and 49*b*, and a generally rectangular dog-leg 51 extending from the inner face. The dog-leg 51 abuts the web 29 and forms a seal between the marginal edge 25*a* of the door 21 and the web.

The gasket retainer 46 comprises an attachment portion 48, a cover abutment wall 54, a gasket compression wall 56 and a gasket containment strip 58. The attachment portion 48 includes horizontal adjustment slots 50 through which fasteners 52 extend into the door frame 26. The fasteners are preferably hex bolts which threadingly engage the frame webs 29. Styrofoam backing members 53, disposed within the cavity on the wall side of the web 29, create a bolt protrusion region around which acoustical deadening mortar is poured during the final assembly stage. The adjustment slots 50 allow a predetermined level of compression between the door 21 and peripheral gasket 44 to be set during installation. Preferably, the compression is such that a thin plastic card may not be inserted between the gasket and the door.

The gasket 44 fits in a cavity defined between the web 29 and the gasket containment strip 58. The containment strip 58 includes a bent end 60 which presses into the resilient gasket 44 to firmly hold the gasket within the retainer 46. The gasket 44 resides fully within the above-mentioned cavity and abuts the gasket compression wall 56. As shown in FIG. 4, the outer panel 23*b* of the acoustic door 21 will contact the inner face of the gasket 44, comprising regions 49*a* and 49*b*, to press the gasket against the compression wall 56.

The cover abutment wall 54 serves to locate a cosmetic cover 62 over the retainer. The cosmetic cover 62 forms a generally L-shape with an outer side plate 66 and a jamb face 64 extending over the retainer 46. Self drilling and tapping screws (not shown), or other fasteners, firmly affix the cosmetic cover 62 to the retainer 46 through the abutment wall 54 and side plate 66.

Figure 5A:
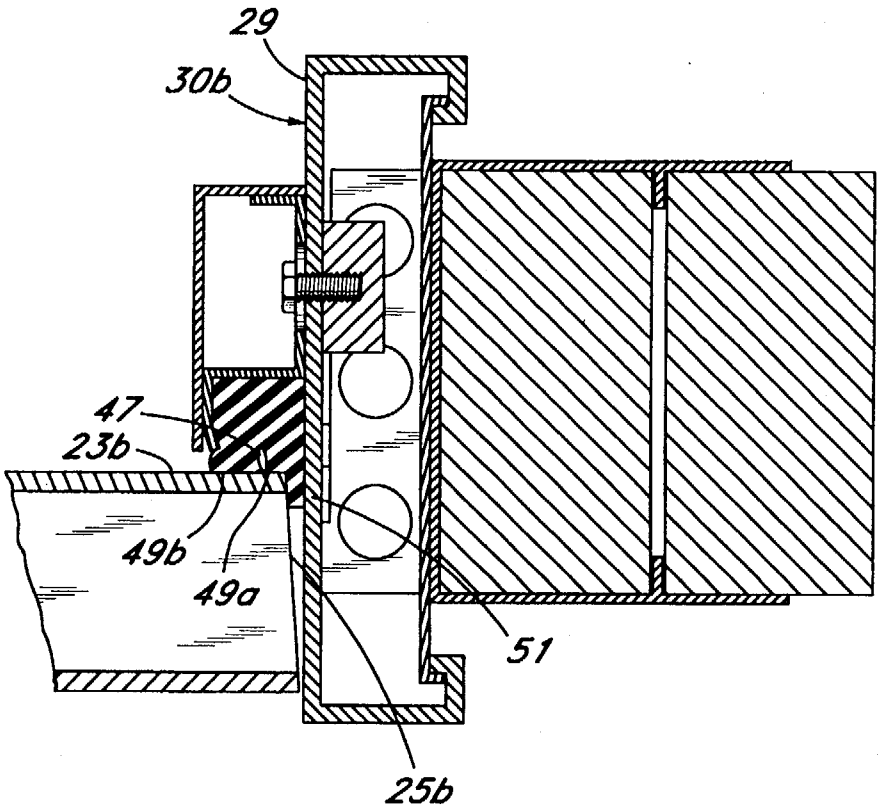
FIG. 5*a* is a cross-sectional view taken along line 5*a*—5*a* of FIG. 1 on the side opposite the hinge showing the door closed and the peripheral gasket in a deformed state.
Figure 5:
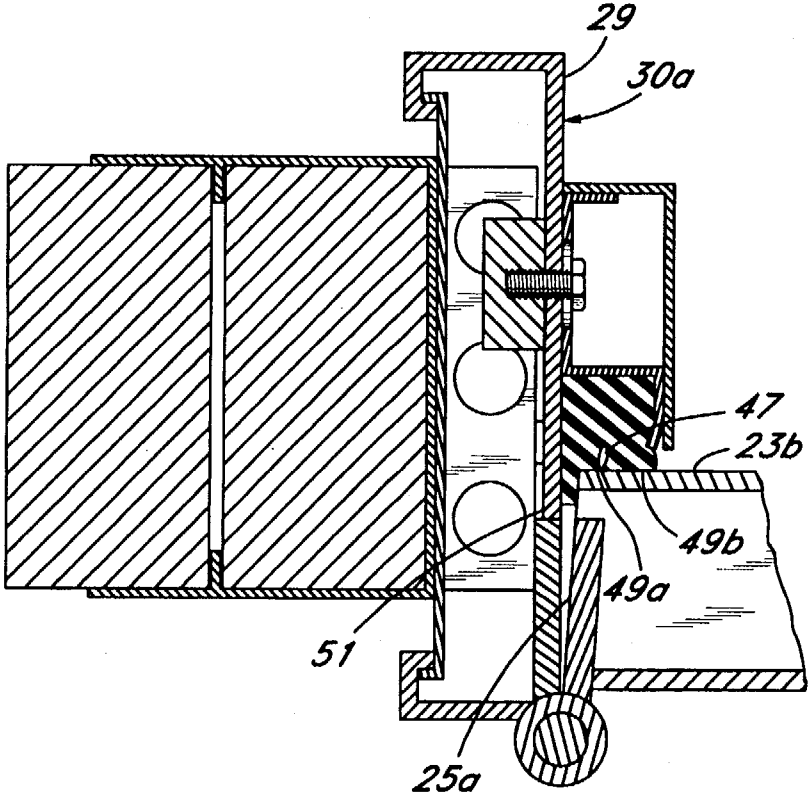
FIG. 5 is a cross-sectional view taken along line 5—5 of FIG. 1 through the hinge showing the door closed and the peripheral gasket in a deformed state.

Now referring to the peripheral gasket 44 in the door closed position, as shown in FIGS. 5 and 5*a*, the dog-leg 51 is compressed by the marginal edges 25*a,b* of the door against the frame web 29. The compression reduces the thickness of the dog-leg 51 and creates an effective sound barrier between the marginal edges 25*a,b* of the door and frame web 29. The first region 49*a* of the inner face of the gasket 44 tends to be pulled toward the frame door jambs 30*a,b* as the dog-leg 51 is compressed. The second region 49*b* of the gasket inner face experiences almost total compression without shear, due to the separation from the dog-leg 51 by the slit 47. The second region 49*b* thus squarely contacts the rear panel 23*b* of the door, forming an effective acoustical seal.

In the preferred embodiment, the rectangular main body 45 of the peripheral gasket 44 has a transverse width of about 1 inch and a length of about 1.3 inches. The width dimension refers to the direction from the frame web 29 to the gasket containment strip 58. The dog-leg 51 extends about 0.2 inch from the main body 45 in the length dimension along the frame side and has a width of about $\frac{1}{4}$ inch. Preferably, the V-shaped slit 47 comprises a single cut perpendicular to the inner surface dividing the surface into regions 49*a* and 49*b*. The slit 47 is preferably to a depth of $\frac{3}{4}$ inch and is made slightly off the main body 45 centerline in the width dimension toward the dog-leg 51. More preferably, the first section 49*a* has a width of about 0.2 inch from the dog-leg 51 to the slit 47, and the second section 49*b* has a width of about $\frac{5}{8}$ inch from the slit to the edge of the main body 45. Other dimensions are possible the advantageous sealing capacity of the peripheral gasket 44 thus is not limited to the preferred embodiment described.

Figure 6:
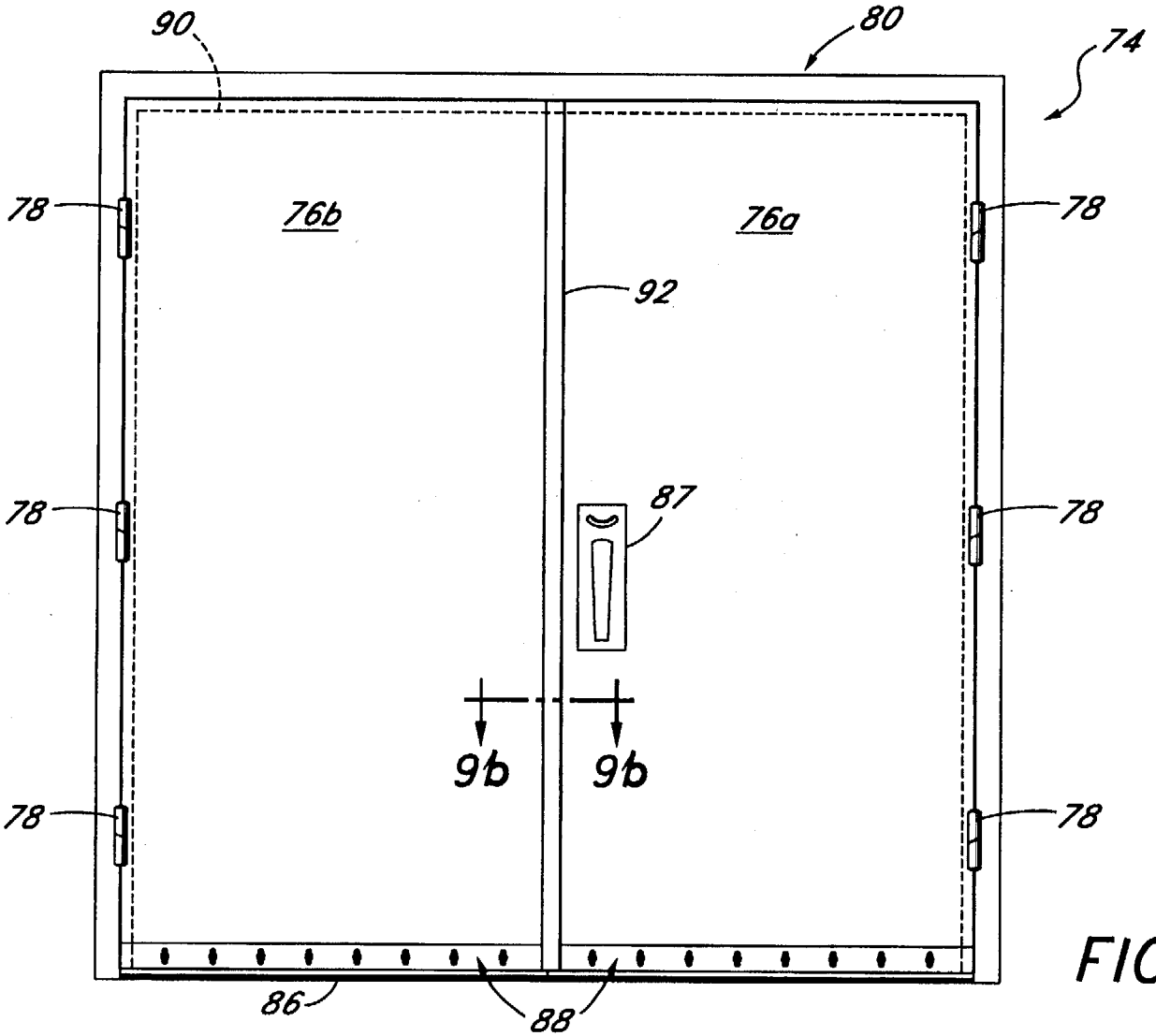
FIG. 6 is a front elevational view of a double acoustical door system of the present invention with the doors closed and a peripheral seal shown in phantom lines.
Figure 7:
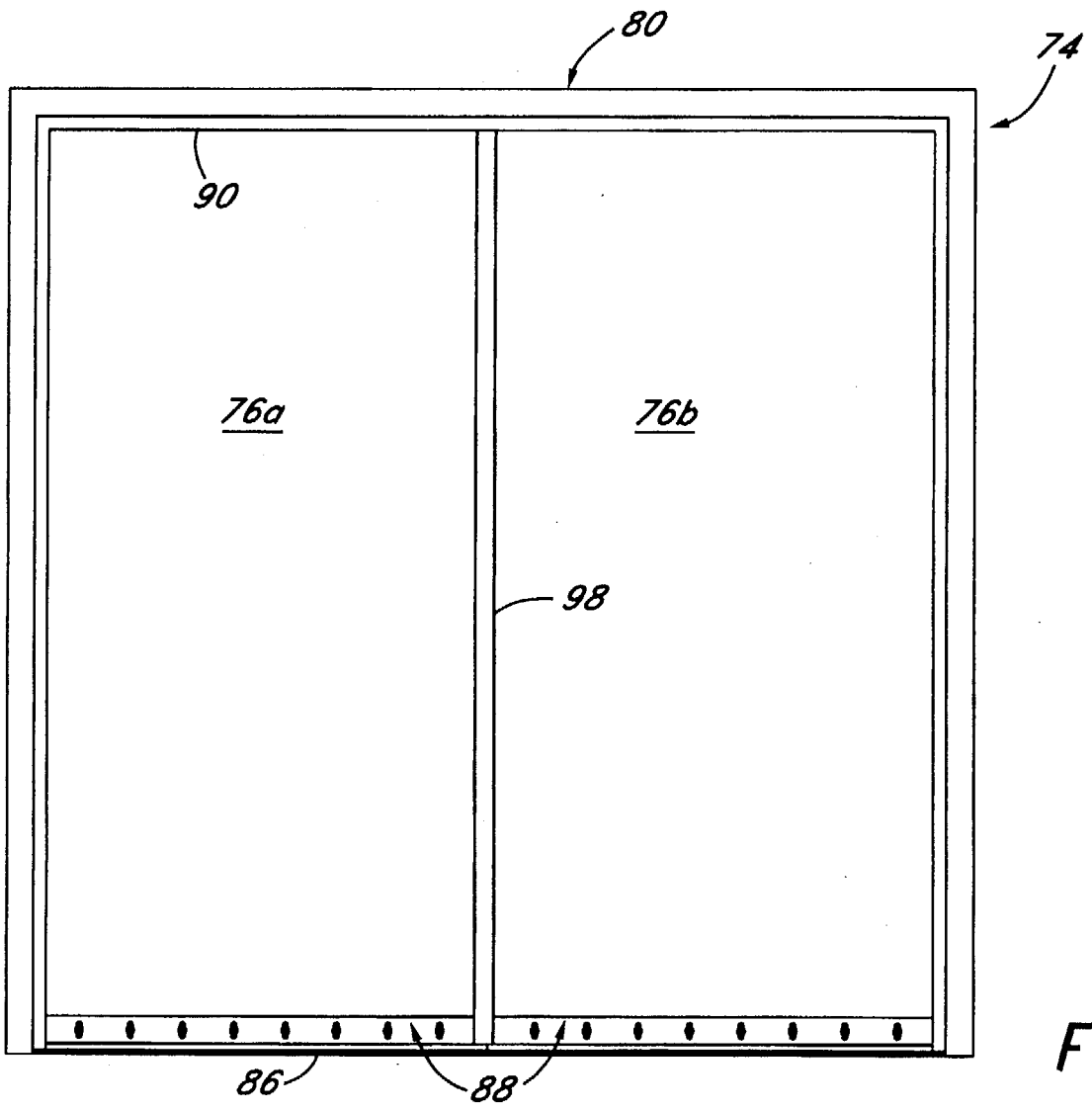
FIG. 7 is a rear elevational view of the double acoustical door system of FIG. 6.

In a second embodiment of the present invention, as shown in FIGS. 6 and 7, a double door system 74 provides an improved acoustical barrier within a double door-sized opening. First and second acoustic doors 76*a* and 76*b*, respectively, swing outward on a plurality of camming hinges 78, similar to those described for the single acoustical door system 20. A double door frame 80 possesses a similar construction as that of the single frame 26, as described above, and includes a doorstep or threshold 86. A conventional door handle 87, or any other well known handle, and accompanying latching and locking means (not shown) are incorporated into the door system 74.

Both acoustic doors 76*a,b* include bottom adjustable seals 88, identical to the bottom seal 33, as also described above. Likewise, peripheral gaskets or seals 90 extend around the right and left frame pieces 84*a,b* and upper frame piece 82 in the same configuration as the single door peripheral gaskets 44. In fact, the seals around. the outer edges of the double doors 76 resemble exactly those described around the outer edges of the single acoustical door system 20.

Figure 9A:
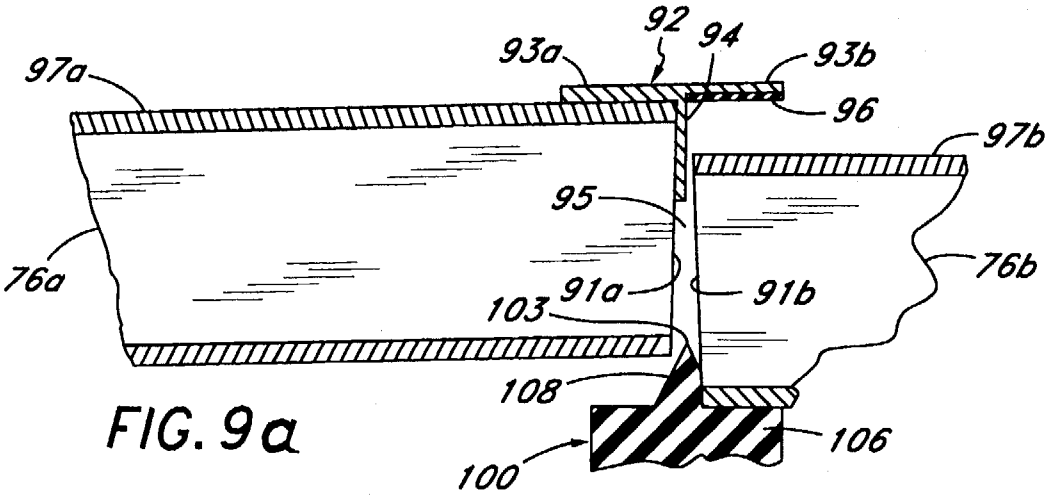
FIG. 9*a* is a cross-sectional view showing the central astragal gasket in an undeformed state just prior to an outer door closing.
Figure 9B:
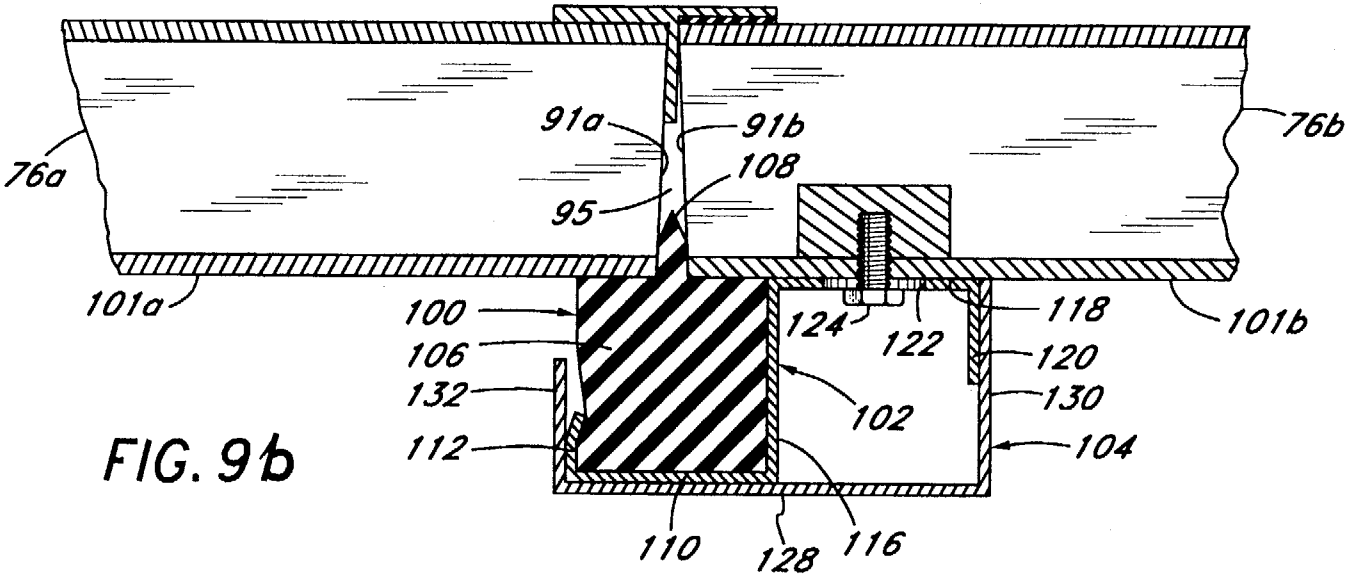
FIG. 9*b* is a cross-sectional view taken along line 9*b*—9*b* of FIG. 6 showing the central astragal gasket in a deformed state after both doors are closed.

As seen in FIGS. 6, 9*a* and 9*b*, an outer T-shaped security plate 92 mounts to the marginal mating edge 91*a* of the first acoustic door 76a and includes a central portion 94 which affixes to the marginal mating edge of the door. The manner of mounting the security plate 92 to the door 76*a* includes fasteners, nails, or any other means well-known in the art. One flange 93*a* of the security plate 92 extends a short distance over the outer panel 97*a* of the acoustic door 76*a*, while the opposite flange 93*b* extends across an angular gap 95 between the two doors 76*a* and 76*b* and a short distance over the outer panel 97*b* of the second acoustic door 76*b*. An elastomeric cushion strip 96 adheres to the inner side of the flange 93*b* of the security plate 92 such that the strip comes in contact with the outer panel 97*b* of the door 76*b* when the doors are closed. Thus, the door 76*b* must be closed first before the door 76*a* is closed.

The angular gap 95 is formed between the tapered facing edges 91*a,b* of the doors 76*a,b*. The tapered edge configuration enables the edges 91*a,b* to come extremely close together when the doors are closed while still allowing the doors 76 to swing open without contacting one another. A central acoustic seal 98 attaches to the inner panel 101*b* of the door 76*b* to provide an acoustic seal across and within the angular gap 95.

Figure 8:
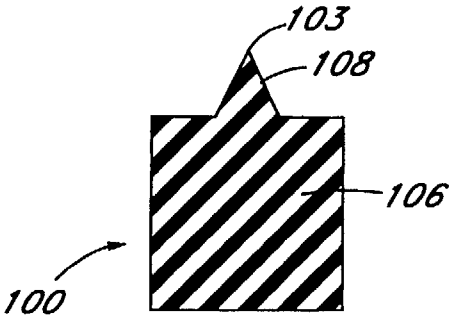
FIG. 8 is a cross-sectional view of a preferred astragal gasket for use between the double doors of FIGS. 6 and 7.

The central acoustic seal 98 comprises an astragal gasket 100, an astragal retainer 102 and an astragal retainer cover 104. The astragal gasket 100 generally comprises a rectangular shaped main body portion 106 with an outward projection 108, as seen in FIG. 8.

Referring to FIG. 9*b*, the astragal retainer 102 includes a compression wall 110, a containment strip 112, a positioning wall 116, an attachment portion 118 and a cover abutment wall 120. The attachment portion 118 fits flush against the inner panel 101*b* of the second acoustic door 76*b* and includes horizontal adjustment slots 122 through which fasteners 124 extend into the second acoustic door. The adjustment slots 122 allow for lateral movement of the central acoustic seal 98 to adjust for variances in assembly of the double door system 74. The astragal retainer cover 104 fits onto the retainer 102 to provide an aesthetically pleasing appearance on the inner side of the double door system 74. The cover 104 comprises an inner wall 128, an attachment plate 130 and an overlap plate 132. The attachment plate 130 mounts to the cover abutment wall 120 with self drilling and tapping screws (not shown).

FIG. 9*a* illustrates the advantageous V-shape clearance of the projection 108. As the first door 76*a* closes on the second door 76*b*, the tapered edge 91a clears an extreme tip 103 of the projection 108. The clearance afforded by the V-shape of the projection 108 prevents the edge 91*a* from prematurely compressing the projection toward the main body portion 106. Thus, as subsequently shown in FIG. 9*b*, the projection remains centered within the gap 95 and evenly in contact with both door edges 91*a* and 91*b*.

In the preferred embodiment, the astragal gasket main body portion 106 comprises a rectangle having a width dimension of about 1⅜ inches and a length of about 1 inch. The length dimension is the direction from the door 76*b* to the compression wall 110. The projection 108 is centered in the outer face of the gasket 100 and preferably comprises an isosceles triangle with about a ½-inch base coincident with the outer face and two identical sides joining at the tip 103 a distance of about ½ inch from the base. Other dimensions are possible, the advantageous sealing capacity of the astragal gasket 100 thus is not limited to the preferred embodiment described.

FIG. 9*b* shows the astragal gasket 100 in a deformed state. As stated above, the projection 108 becomes pinched between the facing edges 91*a,b* of the doors to form an acoustic seal therebetween. Additionally, the main body 106 is compressed between the compression wall 110 and inner door panels 101*a,b*. Thus, the astragal gasket 100 effectively seals against two perpendicular surfaces of each double door 76.

Advantageously, referring to FIG. 7, the central seal 98 extends to the very bottom edge of the doors. In this regard, the small gap between the bottom seals 88 is closed by the central seal 98. At the top of the doors. however, the seal 98 terminates below the top edge of the doors, allowing the top edge to close into contact with the upper peripheral seal 90. The central seal 98 is positioned slightly below the peripheral seal when the doors are closed to minimize any acoustical gap.

The peripheral gasket 44 is preferably manufactured from a closed cell neoprene sponge rubber. The preferred density range of the gasket 44 is between 7.5- and 20-lb. mass per cubic foot. A preferred measure of compression or deflection level is 2–5 lbs./sq. in. In other words, the material can withstand a pressure of between 2–5 lbs./sq. in. before deflecting. A preferred neoprene for the gasket 44 is manufactured by the Rubatex Corporation with the Stock No. R-1410-9. The material for the bottom sealing strip 42 is similar to that of the peripheral gasket 44 but possesses a higher density, preferably in the range of 20–25 lb. mass per cubic foot.

The final step of frame installation involves the pouring of sound-deadening mortar into the top cf the space behind the frame web 29. A frame anchor 134 provides structural support for the channel-shaped frame 26 and has vertical apertures 136 through which mortar may flow from above. The frame 26 includes a vertical mortar guard 138 which prevents mortar from seeping out from between the frame and wall studs.

While the above description represents the preferred embodiments, the present invention may be embodied in other specific forms without departing from its spirit or essential characteristics. The described embodiment is to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed is:

1. An acoustical door system, comprising:

an acoustical door;

a door frame having vertical sides and an upper crosspiece, said door adapted to fit within said frame in a closed position whereby a peripheral edge of said door lies adjacent to the frame vertical sides and upper crosspiece; and an elastomeric seal supported by one or more of said frame sides and upper crosspiece, and extending into the doorway defined by said frame, said seal having a door edge engaging portion which has a substantial surface area in contact with the door edge in the door closed position and is compressed between the edge of said door and said frame in the door closed position to form an acoustic barrier, and a door face engaging portion which is compressed against a face portion of said door in the door closed position to form a second acoustical barrier.

2. The system of claim 1, wherein the cross section of said seal has a generally rectangular body with a dogleg extension which forms said edge engaging portion.

3. The system of claim 1, wherein said seal door edge engaging portion and said door face engaging portion form approximately a 90° angle in which a portion of the door edge and a portion of the door face is received.

4. The system of claim 1, including a retainer secured to said frame holding said seal in proper position on said frame with respect to said door.

5. The system of claim 4, wherein said seal door face engaging portion extends generally perpendicularly to the door frame and said retainer holds the seal so that the face engaging portion is compressed between the door face and the retainer.

6. The system of claim 1, including one or more camming hinges mounting the door to the door frame which raise the door upon opening and lower it upon closing, and an elastomeric strip attached to the lower edge of the door to be compressed between a frame threshold and the lower edge of the door in the door closed position.

7. The system of claim 6, including a U-shaped support having its open end facing upwardly and secured to the lower edge of said door, with said elastomeric strip being attached to said support, said support being vertically adjustable to obtain the desired compression of said elastomeric strip in the door closed position.

8. The system of claim 7, wherein both faces of the door adjacent the lower edge of the door are recessed so that the legs of the support when mounted on the door are flush with the face of the door so that proper side edge sealing is obtained with said elastomeric seal in the door closed position.

9. The system of claim 1, including a second acoustical door with the doors being hinged in said door frame to form a double door arrangement, said second door also adapted to fit within said frame in a second door closed position, wherein non-hinged mating edges of tghe doors are positioned adjacent to each other in the first and second door closed positions to define a mating edge gap therebetween, and a resilient gasket mounted on one of said doors to extend across said gap between mating door edges, said gasket including a projection that extends into said mating edge gap and is compressed between the mating edges to provide an acoustical barrier.

10. The system of claim 9, wherein said projection has a V-shaped cross section oriented such that the tip of the V-shape extends into said mating edge gap.

11. The system of claim 10, wherein the mating edges of said double doors are angled to permit hinging action of one door with respect to the other while minimizing the gap between the mating edges, and wherein the angle of said projection tip extending into the mating edge gap is greater than the angle formed by said door edges so that a corner of the other of said doors will not engage the tip of said projection but will engage a side of said projection and compress said projection as said door is moved to its closed position.

12. An acoustical door system, comprising:

an acoustical door;

a door frame having vertical sides and an upper crosspiece, said door adapted to fit within said frame in a closed position whereby a peripheral edge of said door lies adjacent to the frame vertical sides and upper crosspiece; and an elastomeric seal supported by one or more of said frame sides and upper crosspiece, and extending into the doorway defined by said frame, said seal having a door edge engaging portion which is compressed between the edge of said door and said frame in the door closed position to form an acoustic barrier, and a door face engaging portion which is compressed against a face portion of said door in the door closed position to form a second acoustical barrier, wherein said seal door face engaging portion has a slit separating said door face engaging portion into a first section adjoining said door edge engaging portion, and a second section spaced from said door edge engaging portion and being not appreciably affected by the compression of said door edge engaging portion.

13. The system of claim 12, including one or more camming hinges mounting the door to the door frame which raise the door upon opening and lower it upon closing, and an elastomeric strip attached to the lower edge of the door to be compressed between a frame threshold and the lower edge of the door in the door closed position.

14. An acoustical door system, comprising:

a pair of doors adapted to be movable into a closed position with the doors having mating vertical edges positioned adjacent each other to define a gap; and a vertically extending gasket attached to one of said doors to engage a portion of a face of said one door adjacent the mating vertical edge and extending across said gap formed by the mating edges of said doors to engage a face of the other of said doors adjacent its mating vertical edge so as to form an acoustical barrier, said gasket including a projection which extends into said gap and is compressed between the mating vertical edges to enhance the sound barrier.

15. The system of claim 14, wherein the doors are hinged and mating edges of said doors define an acute angle that accommodates hinging movement of one door with respect to each other while minimizing the gap between the doors, said gasket projection has an angled tip extending furthest into said gap located so that the mating vertical edge of the other of said doors does not engage the tip of said projection when the doors are hingedly moved relative one another, but the angle of said projection tip is greater than the door edge angle such that said other door mating vertical edge engages and compresses said projection in the door closed position.

* * * * *